US012557863B2

(12) United States Patent
Israel et al.

(10) Patent No.: US 12,557,863 B2
(45) Date of Patent: Feb. 24, 2026

(54) BARRIER SYSTEM FOR PERSONAL PROTECTIVE EQUIPMENT

(71) Applicant: O&M Halyard, Inc., Mechanicsville, VA (US)

(72) Inventors: Samuel G. Israel, Alpharetta, GA (US); Jason M. Gibson, Smyra, GA (US)

(73) Assignee: O&M Halyard, Inc., Glen Allen, VA (US)

( * ) Notice: Subject to any disclaimer, the term of this patent is extended or adjusted under 35 U.S.C. 154(b) by 0 days.

(21) Appl. No.: 18/359,980

(22) Filed: Jul. 27, 2023

(65) Prior Publication Data

US 2024/0032633 A1 Feb. 1, 2024

Related U.S. Application Data

(60) Provisional application No. 63/394,074, filed on Aug. 1, 2022.

(51) Int. Cl.
*A41D 27/24* (2006.01)
*A41D 13/12* (2006.01)

(52) U.S. Cl.
CPC ..... *A41D 27/245* (2013.01); *A41D 13/12* (2013.01)

(58) Field of Classification Search
CPC ..... A41H 43/04; A41D 27/24; A41D 27/245; A41D 13/12
See application file for complete search history.

(56) References Cited

U.S. PATENT DOCUMENTS

| | | | |
|---|---|---|---|
| 3,486,964 | A | 12/1969 | Brunlid |
| 4,635,628 | A | 1/1987 | Hubbard et al. |
| 5,444,873 | A | 8/1995 | Levin |
| 5,865,919 | A | 2/1999 | Megchelsen et al. |
| 6,851,125 | B2 | 2/2005 | Fujikawa et al. |
| 6,934,969 | B2 | 8/2005 | Schorr et al. |
| 7,155,746 | B2 | 1/2007 | Schorr et al. |
| 7,504,060 | B2 | 3/2009 | Brock et al. |
| 8,333,918 | B2 | 12/2012 | Lennon et al. |
| 8,813,755 | B2 | 8/2014 | Hoffmann |
| 8,927,443 | B2 | 1/2015 | Chakravarty et al. |
| 10,190,244 | B2 | 1/2019 | Ashraf et al. |
| 10,602,786 | B2 | 3/2020 | Harris et al. |
| 10,632,714 | B2 | 4/2020 | Zhao |

(Continued)

FOREIGN PATENT DOCUMENTS

| | | | |
|---|---|---|---|
| CA | 2999644 | A1 | 9/2019 |
| EP | 1 695 638 | A1 | 8/2006 |

(Continued)

OTHER PUBLICATIONS

Translation of WO2017/119355. (Year: 2017).*

(Continued)

*Primary Examiner* — Catherine A. Simone
(74) *Attorney, Agent, or Firm* — Dority & Manning, P.A.

(57) ABSTRACT

A seam pattern is provided. The seam pattern includes a continuous double bar having a first continuous bar and a second continuous bar. The seam pattern further includes at least one discontinuous bar located between the first continuous bar and the second continuous bar. The seam pattern creates a seal when joining a first material with a second material.

18 Claims, 13 Drawing Sheets

(56) References Cited

U.S. PATENT DOCUMENTS

| | | | |
|---|---|---|---|
| 10,888,471 | B2 | 1/2021 | Ashraf et al. |
| 10,945,475 | B2 | 3/2021 | Ponich et al. |
| 10,968,552 | B2 | 4/2021 | Ashraf et al. |
| 11,034,072 | B2 | 6/2021 | Middlesworth |
| 11,090,197 | B2 | 8/2021 | Ashraf et al. |
| 11,149,360 | B2 | 10/2021 | Ashraf et al. |
| 2002/0022114 | A1 | 2/2002 | Sorensen et al. |
| 2012/0251771 | A1 | 10/2012 | Wilson et al. |
| 2016/0318281 | A1 | 11/2016 | Ikoma et al. |
| 2017/0087029 | A1 | 3/2017 | Nelson et al. |
| 2019/0003079 | A1 | 1/2019 | Ashraf et al. |
| 2020/0085629 | A1 | 3/2020 | Locke et al. |
| 2020/0100949 | A1 | 4/2020 | Smith et al. |
| 2020/0179183 | A1 | 6/2020 | Schoon et al. |
| 2020/0237576 | A1 | 7/2020 | Coenen et al. |
| 2020/0299882 | A1 | 9/2020 | Baer et al. |
| 2021/0244111 | A1 | 8/2021 | Lai et al. |
| 2021/0292944 | A1 | 9/2021 | Lindsay et al. |
| 2022/0218054 | A1 | 7/2022 | Lo |

FOREIGN PATENT DOCUMENTS

| | | | |
|---|---|---|---|
| EP | 1 594 690 | B1 | 8/2017 |
| WO | WO 2017/119355 | A1 | 7/2017 |
| WO | WO 2018/101789 | A1 | 6/2018 |
| WO | WO 2019/026010 | A1 | 2/2019 |

OTHER PUBLICATIONS

Belsonic International, "Principles of high frequency welding", date unknown, 4 pages.

Eryuruk et al., "A study on ultrasonic welding of nonwovens used for surgical gowns", International Journal of Clothing Science and Technology, vol. 29, No. 4, 2017, 14 pages.

"Level 3 En13975 Ultrasonic Welding 45GSM SMS Disposable Surgical Gown". Downloaded from https://hdfasttech.en.made-in-china.com/product/XByxiJYknCUL/China-Level-3-En13975-Ultrasonic-Welding-45GSM-SMS-Disposable-Surgical-Gown.html, 2021, 3 pages.

International Search Report and Written Opinion for PCT/US2023/028764, dated Oct. 30, 2023, 33 pages.

* cited by examiner

BARRIER SYSTEM FOR PERSONAL PROTECTIVE EQUIPMENT

RELATED APPLICATIONS

The present application claims priority to U.S. Provisional Application Ser. No. 63/394,074, filed on Aug. 1, 2022, which is incorporated herein in its entirety by reference thereto.

FIELD OF THE INVENTION

The present invention relates systems and methods of forming seams or bond patterns that when used in conjunction with medical personal protective equipment ("PPE") (e.g., gowns, togas, hoods, foot coverings, caps, masks, etc.) or medical grade drapes form a fluid barrier on said medical PPE or medical grade drapes capable of stopping the influx or ingress of hazardous fluids.

BACKGROUND OF THE INVENTION

Surgeons and other healthcare providers often wear surgical togas, hoods, caps, foot coverings, and gowns, collectively known as personal protective equipment ("PPE") and use drapes during operating procedures in order to enhance the sterile condition in the operating room and to protect the wearer. In order to prevent the spread of infection to and from the patient, the medical gown prevents bodily fluids and other liquids present during surgical procedures from flowing through the gown.

Medical gowns were originally made of cotton or linen, were reusable, and were sterilized prior to each use in the operating room, but medical gowns have largely replaced the reusable linen medical gown, and many are now made in part or entirely from fluid repellent or impervious fabrics to prevent liquid penetration or "strike through." Various materials and designs have been used in the manufacture of medical gowns to prevent contamination in different operating room conditions. Medical gowns are now available in a variety of different levels of imperviousness.

Specifically, the Association for the Advancement of Medical Instrumentation (AAMI) has proposed a uniform classification system for gowns and drapes based on their liquid barrier performance. These procedures were adopted by the American National Standards Institute (ANSI) and were recently published as ANSIA/AAMI PB70: 2012 entitled Liquid Barrier Performance and Classification of Protective Apparel and Drapes Intended for Use in Health Care Facilities, which was formally recognized by the U.S. Food and Drug Administration in October 2004. This standard established four levels of barrier protection for medical gowns and drapes. The requirements for the design and construction of medical gowns are based on the anticipated location and degree of liquid contact, given the expected conditions of use of the gowns. The highest level of imperviousness is AAMI level 4, used in "critical zones" where exposure to blood or other bodily fluids is most likely and voluminous. The AAMI standards define "critical zones" as the front of the gown (chest), including the tie cord/securing means attachment area, and the sleeves and sleeve seam area up to about 2 inches (5 cm) above the elbow.

Previously, seam areas were formed using techniques such as needle-and-thread, adhesive, or welding. However, these techniques still leave gaps formed at the puncture points of the material where the seams are formed. These gaps diminish the desired fluid barrier properties under the AAMI standards and allow for liquid penetration or "strike through" of the materials used in medical gowns regardless of the materials used.

In light of the above, a need exists for making seams in PPE products and drapes that provide fluid barrier properties similar to the materials which the seam is being formed upon. A need also exists for the fluid barrier seams to exert sufficient mechanical strength to provide for the needs of the medical industry.

SUMMARY OF THE INVENTION

In accordance with one aspect of the present invention, a seam pattern is provided. The seam pattern includes a continuous double bar and at least one discontinuous bar. The continuous double bar includes a first continuous bar and a second continuous bar. The discontinuous bar is located between the first continuous bar and the second continuous bar. Further, the seam pattern creates a seal when joining a first material with a second material.

In one aspect, the at least one discontinuous bar includes a series of dotted or dashed lines.

In another aspect, the continuous double bar and the at least one discontinuous bar are formed via at least one of ultrasonic bonding or welding or thermal bonding.

In yet another aspect, the seam is applied on a drape, gown, a cap, a hood, a mask, a foot covering, or a toga.

In still another aspect, the seam pattern is applied on a rounded portion of the drape, the gown, the cap, the hood, the mask, the foot covering, or the toga.

In a further aspect, the seam pattern is applied on the rounded portion of the drape, the gown, the cap, the hood, the mask, the foot covering, or the toga has a radius of curvature ranging from about 6 mm to about 260 meters.

In yet another aspect, the first and the second material comprise an elastic or polymeric film, wherein the elastic or polymeric film of the first and second material forms a fluid impervious seal when bonded together.

In another embodiment, the present disclosure is directed to a method of forming a seam pattern. The method includes joining at least a first material and a second material with a seam pattern having a continuous double bar including a first continuous bar and a second continuous bar and at least one discontinuous bar located between the first continuous bar and the second continuous bar. Further, the seam pattern creates a seal when joining the first material with the second material.

In still another embodiment, the present disclosure is directed to a personal protective equipment product. The personal protective equipment product includes a first nonwoven material joined to a second nonwoven material by a seam pattern. At least one of the first nonwoven materials comprises an outer nonwoven layer, an inner nonwoven layer, and an elastic or polymeric film placed between the outer nonwoven layer and the inner nonwoven layer. The seam pattern includes a continuous double bar including a first continuous bar and a second continuous bar and at least one discontinuous bar located between the first continuous bar and the second continuous bar.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE FIGURES

A full and enabling disclosure of the present invention to one skilled in the art, including the best mode thereof, is set forth more particularly in the remainder of the specification, including reference to the accompanying figures, in which.

Figure 1:
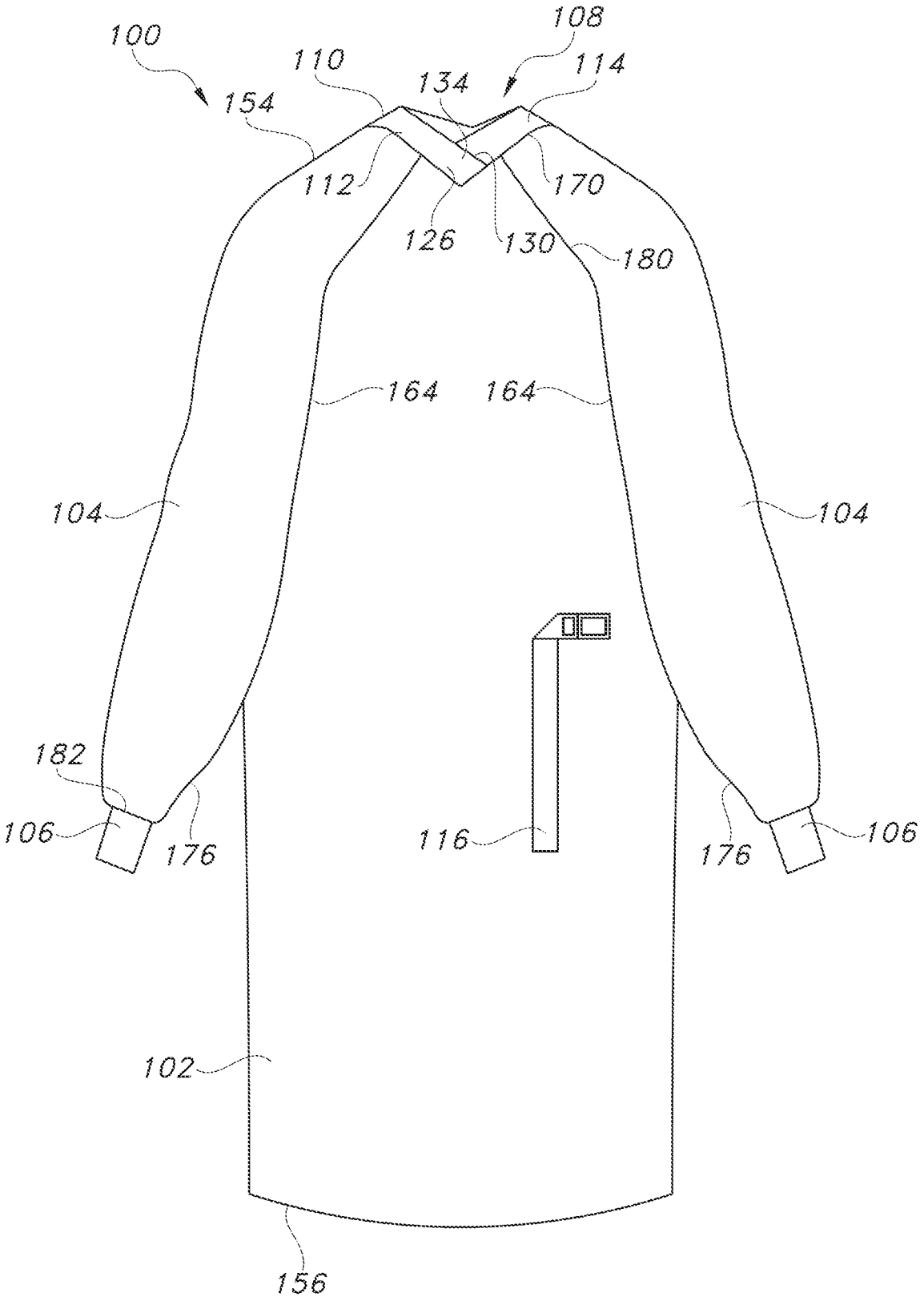
FIG. 1 illustrates a front view of one embodiment of PPE (e.g., a medical gown) according to the present disclosure.

Repeat use of reference characters in the present specification and drawings is intended to represent the same or analogous features or elements of the present invention.

DETAILED DESCRIPTION

Reference now will be made in detail to various embodiments of the invention, one or more examples of which are set forth below. Each example is provided by way of explanation of the invention, not limitation of the invention. In fact, it will be apparent to those skilled in the art that various modifications and variations may be made in the present invention without departing from the scope or spirit of the invention. For instance, features illustrated or described as part of one embodiment, may be used on another embodiment to yield a still further embodiment. Thus, it is intended that the present invention covers such modifications and variations as come within the scope of the appended claims and their equivalents.

Generally speaking, the present invention is directed to a seam pattern that meets the AAMI level 4 critical zone requirements while at the same time being impervious to the ingress of fluids and strong enough for use in the medical field. The seam pattern includes a continuous double bar having a first continuous bar and a second continuous bar. The seam pattern further includes at least one discontinuous bar located between the first continuous bar and the second continuous bar. The seam pattern creates a fluid impervious seal when joining a first material with a second material. It should be understood that the first material and the second material can be the same or different materials and can include sheets, woven materials, nonwoven materials, films, laminates, combinations thereof, or any other suitable types of materials. The combination of features results in a seam pattern capable of preventing the ingress of fluids but that can still provide a sufficient mechanical strength for use in the medical field.

In addition, the seam pattern may be applied upon a fluid impervious material thereby creating a fluid impervious garment. The fluid impervious material may include an outer nonwoven layer that defines an outer-facing surface, an inner nonwoven layer that defines a body-facing surface, and a liquid impervious, moisture vapor breathable elastic or polymeric film disposed therebetween. The outer and inner nonwoven layer may each be formed from a spunbond material, a meltblown material, or spunbond-meltblown-spunbond (SMS) laminate. In one particular embodiment, the outer and inner nonwoven layer may both be SMS laminates. In another embodiment, the outer nonwoven layer can be a spunbond layer and the inner nonwoven layer can be an SMS laminate, or vice versa. The elastic or polymeric film can further include a core layer disposed between a first skin layer and a second skin layer. Further, the core layer can include polypropylene, and the first skin layer and the second skin layer can each include a copolymer of polypropylene and polyethylene. Further still, the core layer can include a fluorochemical additive. The fluorochemical additive can be present in the core layer in an amount ranging from about 0.1 wt. % to about 5 wt. % based on the total weight of the core layer. Further, the core layer can include a filler. The filler can be present in the core layer in an amount ranging from about 50 wt. % to about wt. % based on the weight of the core layer. Furthermore, the outer nonwoven layer and the inner nonwoven layer can each include a slip additive. The slip additive can include erucamide, oleamide, stearamide, behenamide, oleyl palmitamide, stearyl erucamide, ethylene bis-oleamide, N,N'-Ethylene Bis(Stearamide) (EBS), or a combination thereof. Further, if the outer nonwoven layer is a spunbond layer, the slip additive can be present in the outer spunbond layer in an amount ranging from about 0.1 wt. % to about 4 wt. % based on the total weight of the outer nonwoven layer, and wherein the slip additive is present in a layer of any SMS laminate used in either the outer nonwoven layer or the inner nonwoven layer in an amount ranging from about 0.25 wt. % to about 6 wt. % based on the total weight of the layer.

Figure 2:
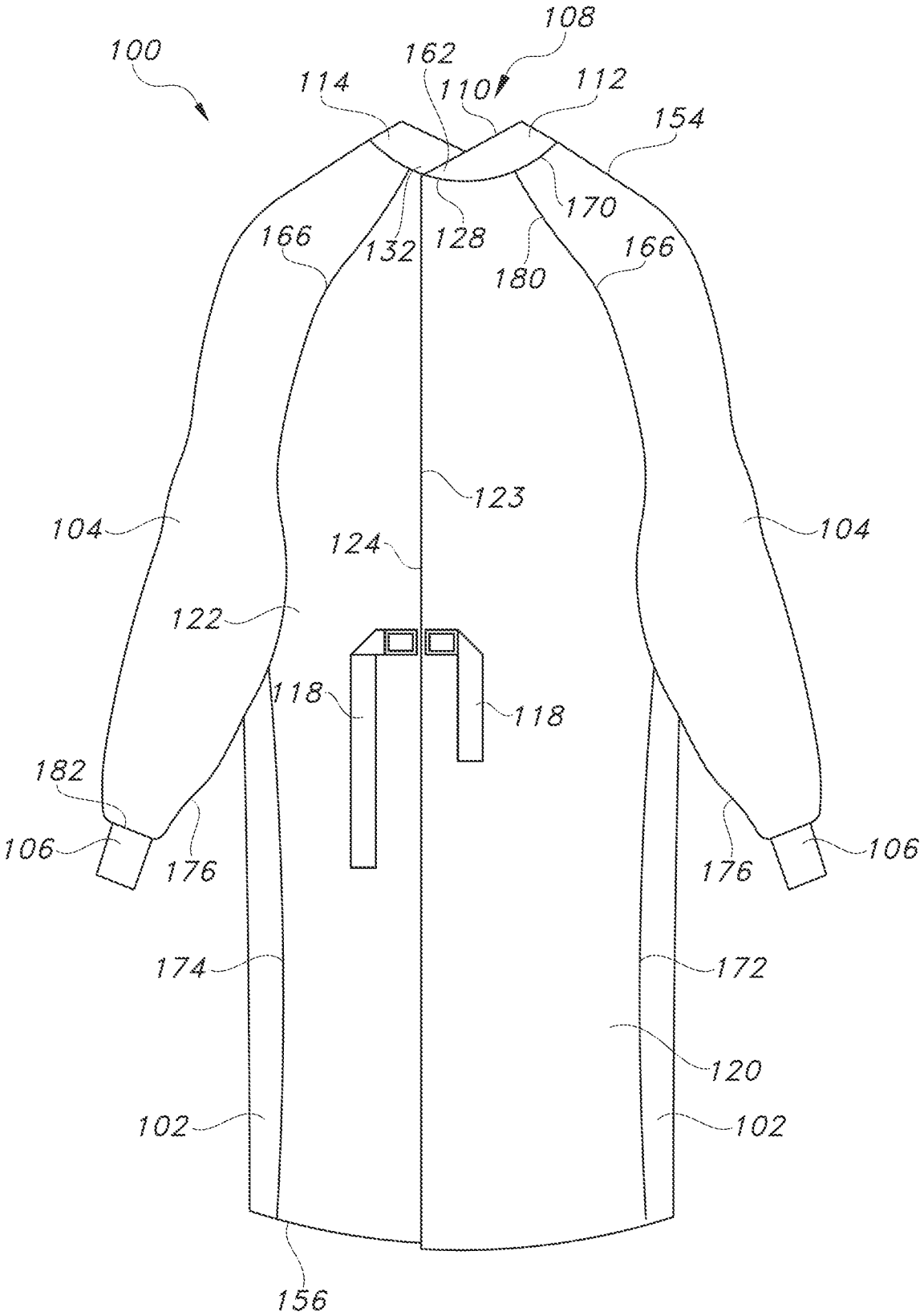
FIG. 2 illustrates a rear view of one embodiment of the medical gown of FIG. 1 according to the present disclosure.
Figure 3:
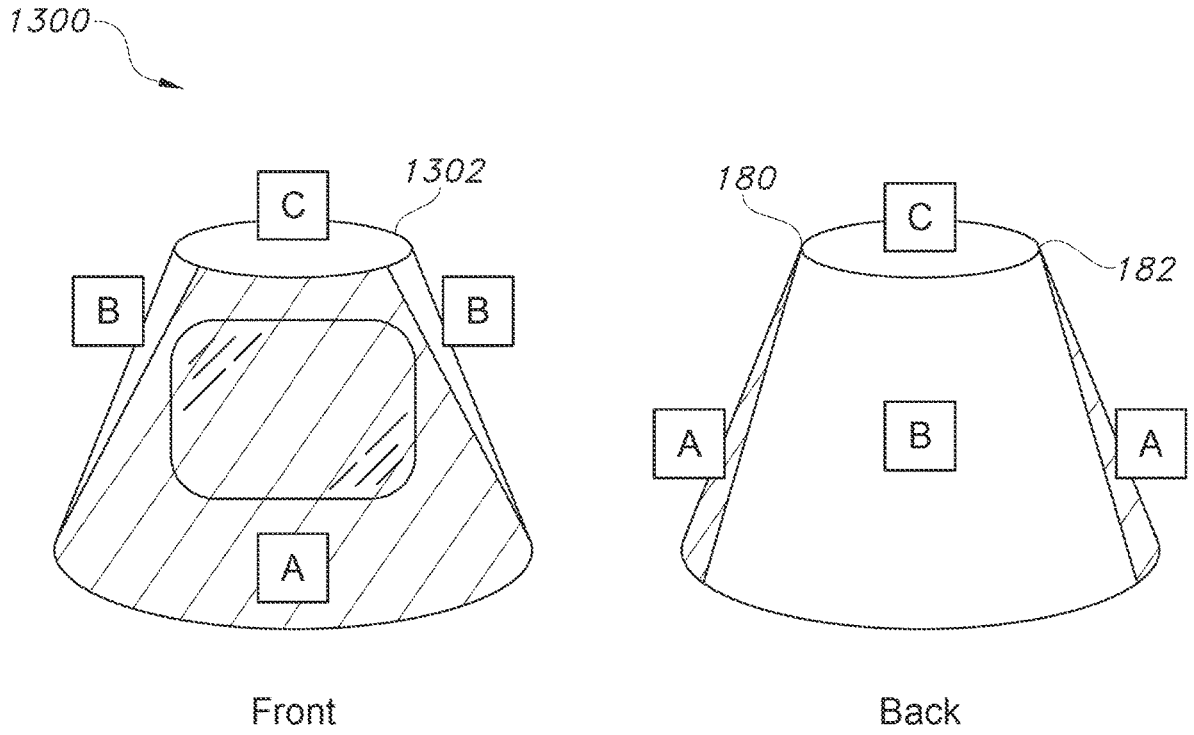
FIG. 3 Illustrates another embodiment of PPE (e.g., a medical hood) according to the present disclosure.
Figure 4:
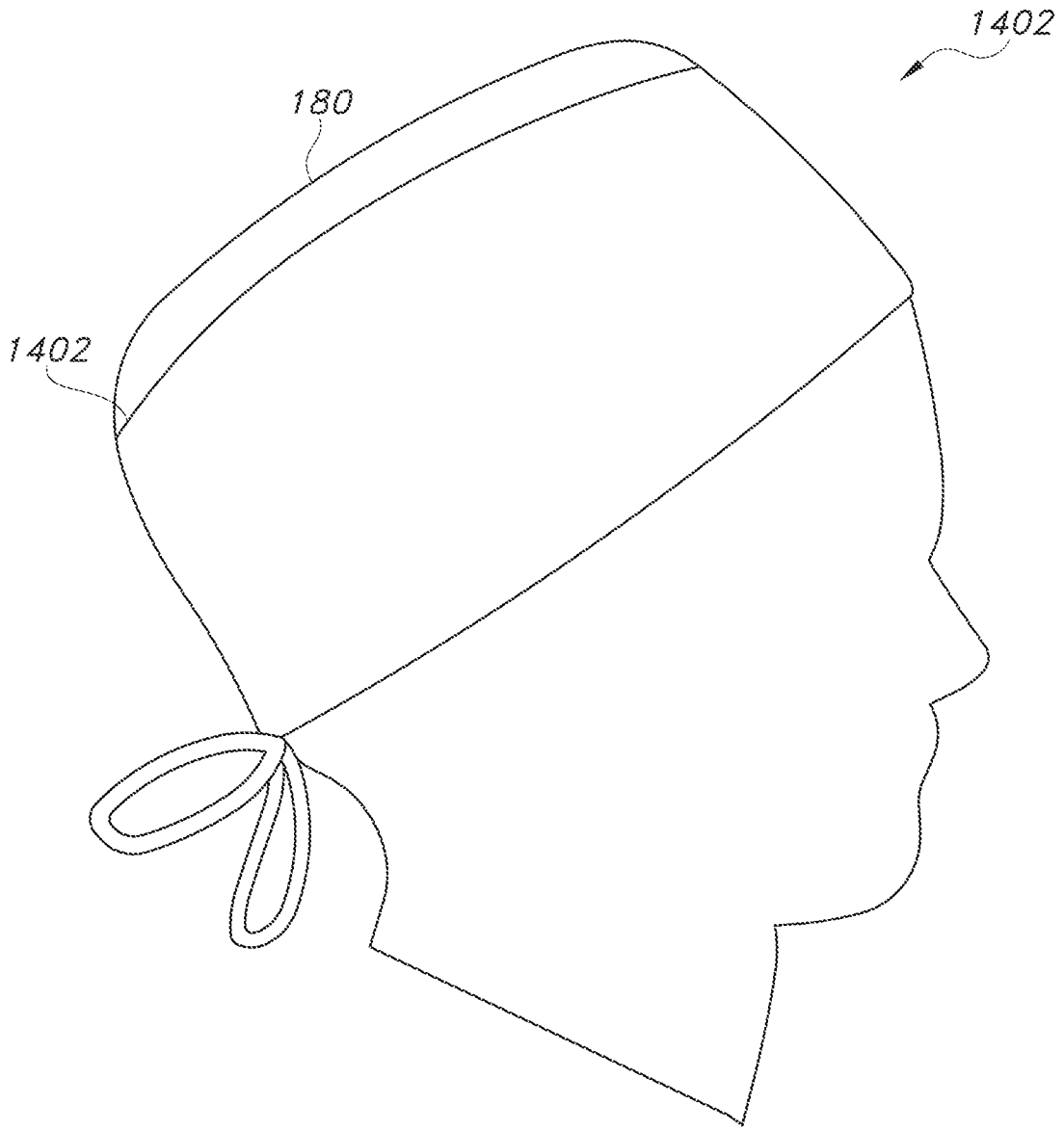
FIG. 4 Illustrates another embodiment of PPE (e.g., a medical cap) according to the present disclosure.
Figure 5:
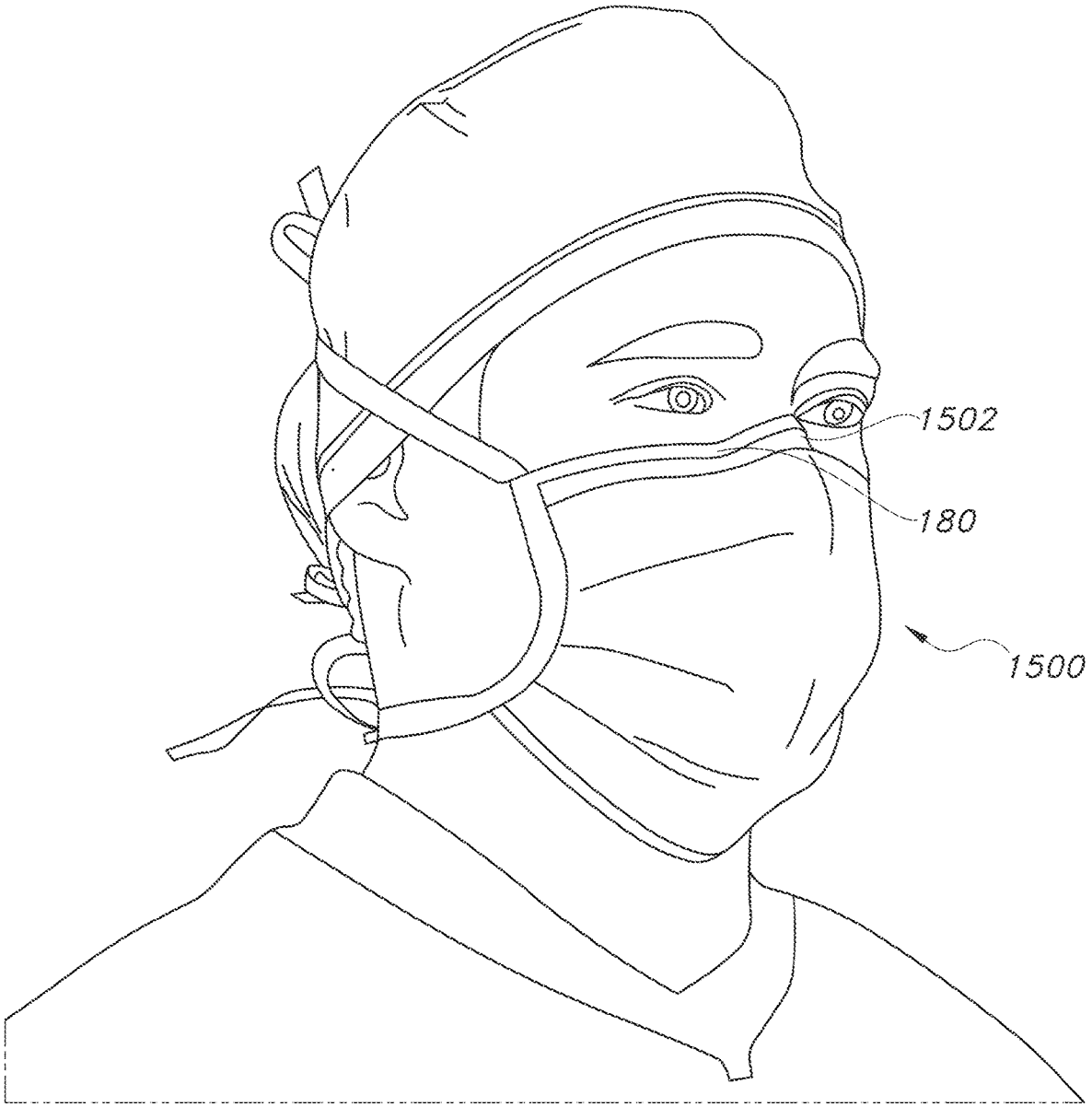
FIG. 5 Illustrates another embodiment of PPE (e.g., a surgical mask) according to the present disclosure.
Figure 6:
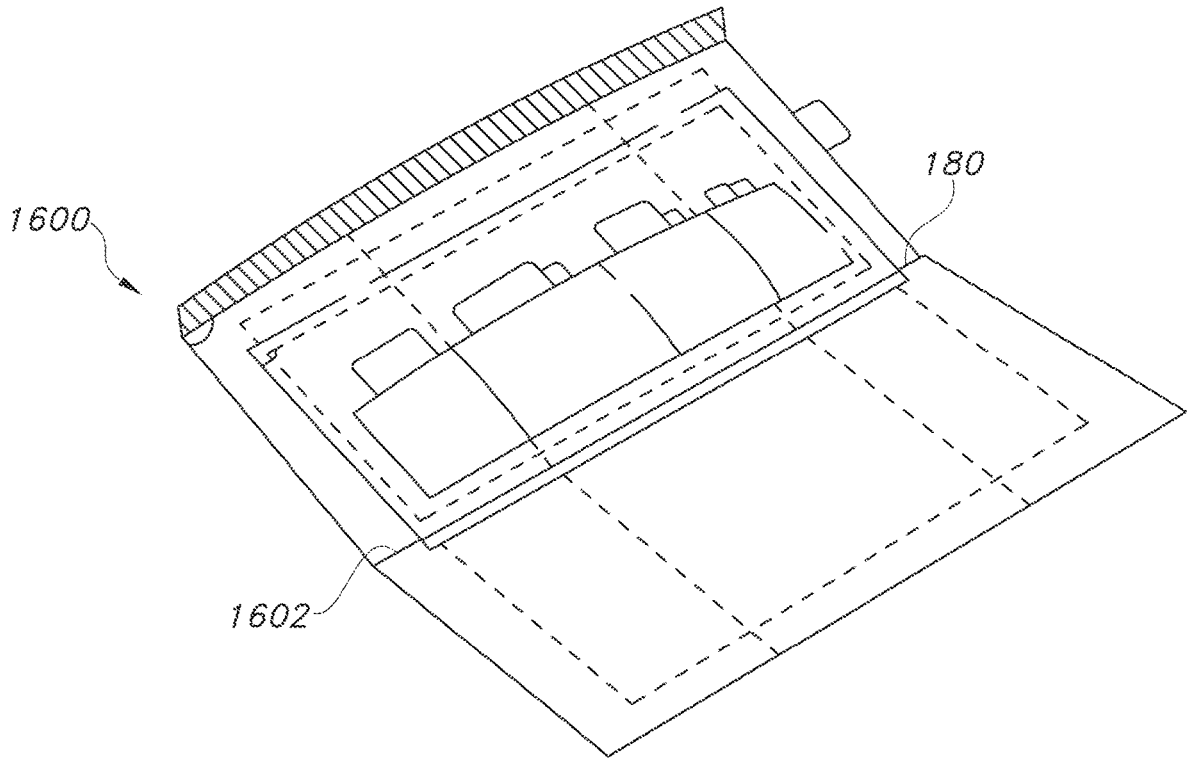
FIG. 6 illustrates another embodiment of PPE (e.g., a medical drape) according to the present disclosure.
Figure 7:
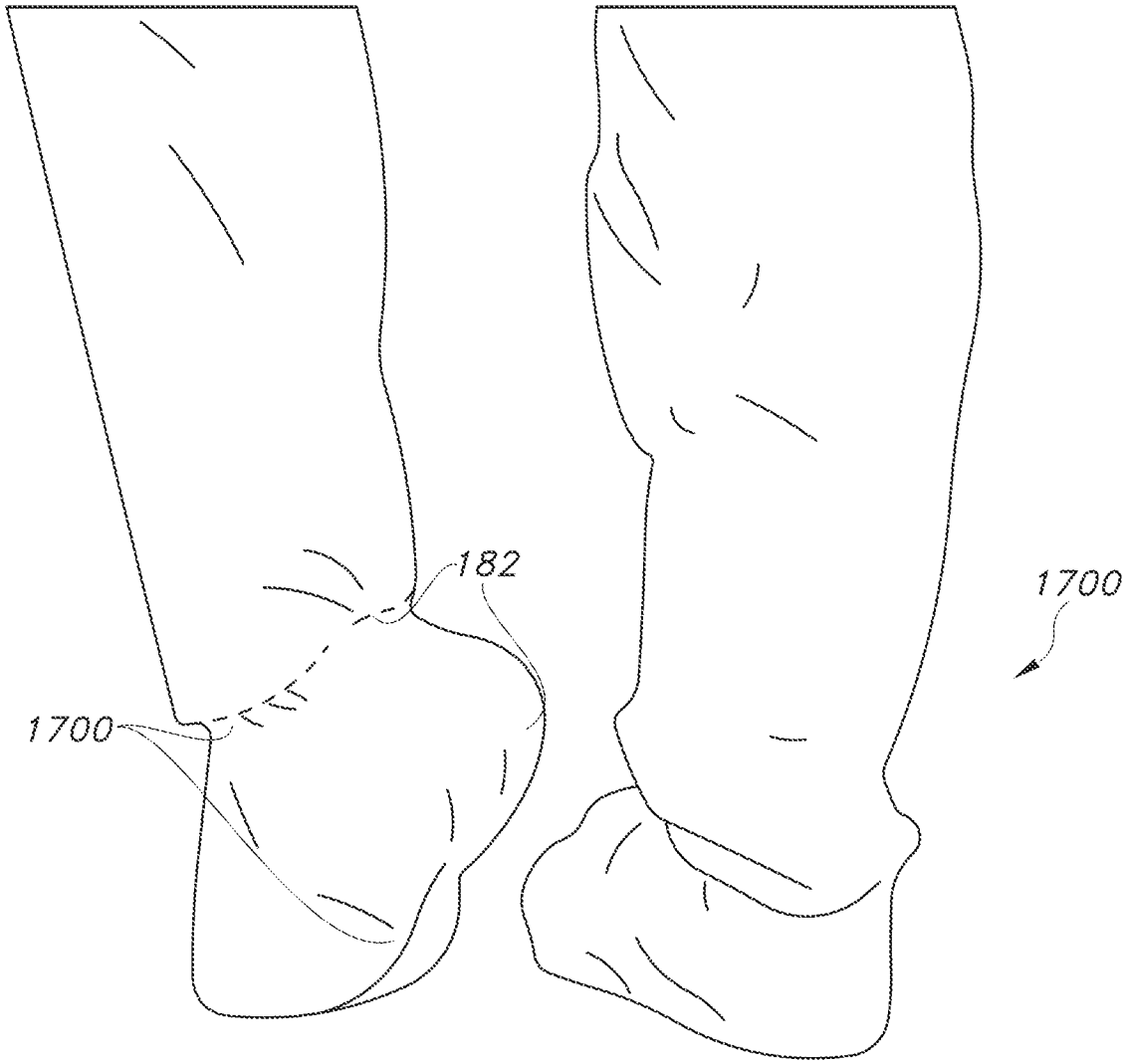
FIG. 7 illustrates another embodiment of PPE (e.g., medical foot coverings) according to the present disclosure.

FIGS. 1-2 show various views of a medical gown 100 that can be worn by medical personnel during a medical examination, surgery, or other procedure. Referring now to FIG. 1, a front view of the medical gown 100 is shown. The medical gown 100 has a proximal end 154 and a distal end 156 that define a front panel 102, where the proximal end 154 includes a collar 110. The medical gown 100 also includes sleeves 104 and cuffs 106. The front panel 102 and the sleeves 104 can be formed from a laminate of an elastic or polymeric film and nonwoven materials, as discussed in more detail below. Further, the sleeves 104 can be any suitable gown sleeve such as raglan sleeves. If the sleeves 104 are raglan sleeves, then each sleeve 104 may extend fully to the collar 110, where a front diagonal seam 164 extends from the underarm up to the collarbone of the wearer and a rear diagonal seam 166 (see FIG. 2) extends from the underarm up to the collarbone of the wearer to attach the sleeves 104 to the front panel 102 and rear panels 120 and 122 of the medical gown 100. The front diagonal seams 164 and the rear diagonal seams 166 of the sleeves 104 can be ultrasonically bonded or welded to the front panel 102 and rear panels 120 and 122 of the gown (as discussed in further detail in reference to FIGS. 10-17). Further, each sleeve 104 can include an attachment point 176 that can extend from the underarm area down to the cuff 106, where such sleeves 104 can be bonded thermally or ultrasonically so that the sleeves 104 comply to their corresponding tests as detailed in ANSI/AAMI PB70 section "2 Normative References"; In addition, the collar 110 can be joined to the front panel 102, the sleeves 104, the first rear panel 120 (see FIG. 2), and the second rear panel 122 (see FIG. 2) at a seam 170 that is formed by utilizing ultrasonic bonding or welding techniques to join the collar 110 to the aforementioned portions of the medical gown 100. Further, a front fastening means 116 can be ultrasonically bonded or welded to the front panel 102 and can be used to secure the medical gown 100 about a wearer when used in conjunction with rear fastening means 118 (see FIG. 2).

Referring now to FIG. 2, a rear of the medical gown 100 is illustrated. The proximal end 154 and the distal end 156 define a first rear panel 120 and a second rear panel 122, which can be formed of a laminate of nonwoven materials, as discussed in more detail below. The first rear panel 120 can be ultrasonically bonded or welded to the front panel 102 at a seam 172, while the second rear panel 122 can be ultrasonically bonded or welded to the front panel 102 at a seam 174, where the first rear panel 120 can be ultrasonically bonded or welded to the front panel 102 at seam 172 and the second rear panel 122 can be ultrasonically bonded or welded to the front panel 102 at seam 174. Such ultrasonic bonding or welding of the rear panels 120 and 122 to the front panel 102 can result in seams 172 and 174 that can have a hydrohead that meets the ASTM F1670 or F1671 testing requirements which are greater than about 50 cm, such as greater than about 75 cm, such as greater than about 100 cm. Further, rear fastening means 118 can be ultrasonically bonded or welded to the edge 123 of the first rear panel 120 and the edge 124 of the second rear panel 122. As shown, the edge 123 of the first rear panel 120 can overlap the edge 124 of the second rear panel 122 when the rear fastening means 118 are tied to secure the medical gown 100 in place, although it is also to be understood that the edge 124 of the second rear panel 122 can overlap the edge 123 of the first rear panel 120 when the rear fastening means 118 are tied to secure the medical gown 100 in place. One or both rear fastening means 118 can also be wrapped around the medical gown 100 and secured to the front fastening means 116. It should be understood that the various seams formed via ultrasonic bonding or welding can also be formed via thermal bonding or any combination thereof.

FIGS. 3-7 show various other types of PPE products that a fluid impervious seam might be implied to prevent the ingress of harmful contaminants. For example, referring to FIG. 3, a medical hood 1300 is illustrated with a medical hood seam 1302. For example, referring to FIG. 4, a medical cap 1400 is illustrated with a medical cap seam 1402. For example, referring to FIG. 5, a surgical mask 1500 is illustrated with a surgical mask seam 1502. For example, referring to FIG. 6, a medical drape 1600 with pockets is shown with a medical drape seam 1602. For example, referring to FIG. 7, medical foot coverings 1700 with foot covering seams 1702 are shown.

Figure 8:
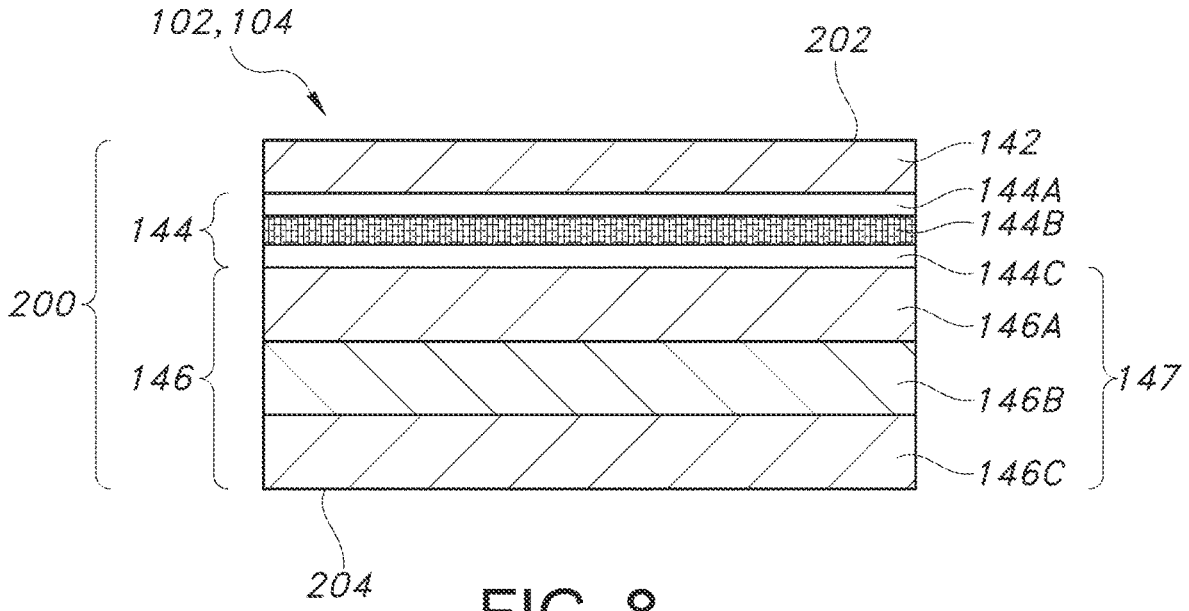
FIG. 8 illustrates a cross-sectional view of one embodiment of a first material that may be used to form the PPE of FIGS. 1-7 and 18-19 according to the present disclosure.

FIG. 8 illustrates a cross-sectional view of a first material 200 which can be used to form the PPE of FIGS. 1-7 and 18-19, where the first material 200 passes ASTM-1671 "Standard Test Method for Resistance of Materials Used in Protective Clothing to Penetration by Blood-Borne Pathogens Using Phi-X174 Bacteriophage Penetration as a Test System." More specifically, when referring to the medical gown 100, the first material 200 can be used to form the front panel 102, the sleeves 104, and the front fastening means 116 of the medical gown 100 of FIGS. 1-2. Although any suitable material can be used, the first material 200 can be a laminate that includes an outer nonwoven layer 142, an elastic or polymeric film 144 containing a skin layer 144A and a second skin layer 144C with a core layer 144B disposed therebetween, and an inner nonwoven layer 147 that may include a spunbond-meltblown-spunbond laminate 146 containing a spunbond layer 146A and a spunbond layer 146C with a meltblown layer 146B disposed therebetween. The outer nonwoven layer 142 can form an outer facing surface 202 of the front panel 102 on the front 158 of the gown 101, the sleeves, the gown 101, the sleeves 104, and the hood 178, while the spunbond layer 146C of the SMS laminate 146 can form the body-facing surface or inner-facing surface 204 of the front panel 102 and the sleeves 104 of the surgical gown 101 as well as the hood 178. The outer nonwoven layer 142 and one or more layers of the inner nonwoven layer 147 can include a slip additive to enhance the softness and comfort of the first material 200, while one or more layers of the elastic or polymeric film 144 can include a fluorochemical additive to enhance the barrier performance of the first material 200. The overall spunbond-film-SMS laminate arrangement of the first material 200 contributes to the moisture vapor breathability of the medical gown 100. It should be understood that in some embodiments, the outer nonwoven layer 142 can be a spunbond layer, while in other embodiments, the outer nonwoven layer can be replaced with a spunbond-meltblown-spunbond laminate, such as SMS laminate 146.

Figure 9:
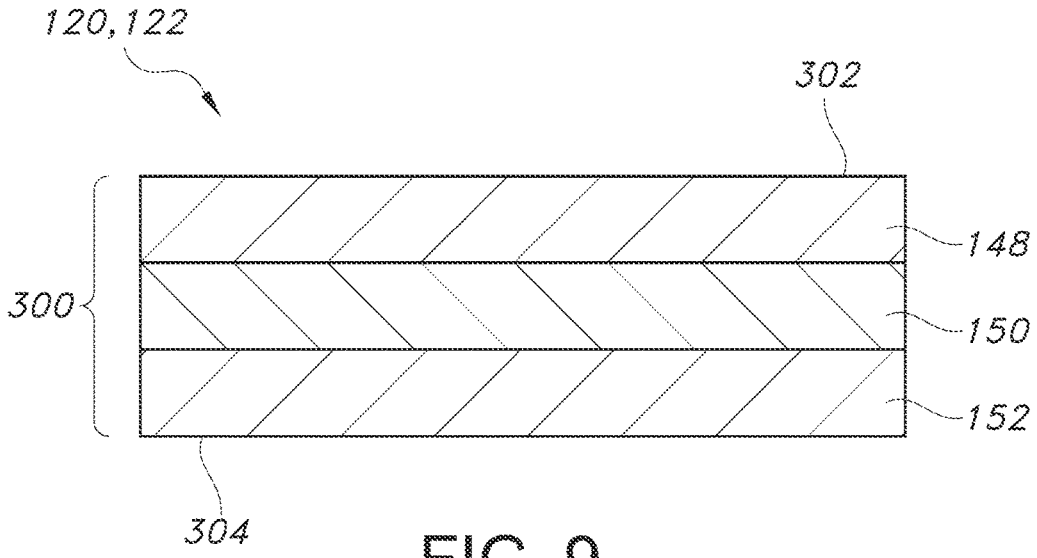
FIG. 9 illustrates a cross-sectional view of one embodiment of a second material that may be used to form the PPE of FIGS. 1-7 and 19-19 according to the present disclosure.

FIG. 9 illustrates a second material 300 that can be used to form the PPE of FIGS. 1-7 and 18-19. More specifically, when referring to the medical gown of FIGS. 1-2, the second material 300 can be used to form the first rear panel 120, the second rear panel 122, and the rear fastening means 118. The second material 300 can be a laminate that includes a first spunbond layer 148, a meltblown layer 150, and a second spunbond layer 152. The first spunbond layer 148 can form an outer-facing surface 302 of the first rear panel 120 and the second rear panel 122 of the surgical gown 101, while the second spunbond layer 152 can form the body-facing surface or inner-facing surface 304 of the first rear panel 120 and the second rear panel 122 of the surgical gown 101. The spunbond layers 148 and 152 can include a slip additive to enhance the softness and comfort of the second material 300, while the overall spunbond-meltblown-spunbond (SMS) laminate arrangement of the second material contributes to the air breathability of the medical gown 100.

In addition, if a medical gown 100 with a complete seal to the ingress of fluids is desired, the first rear panel 120 and the second rear panel 122 may also be formed from the first material 200 such that all panels of the gown 100 are formed from the first material 200.

Figure 10:
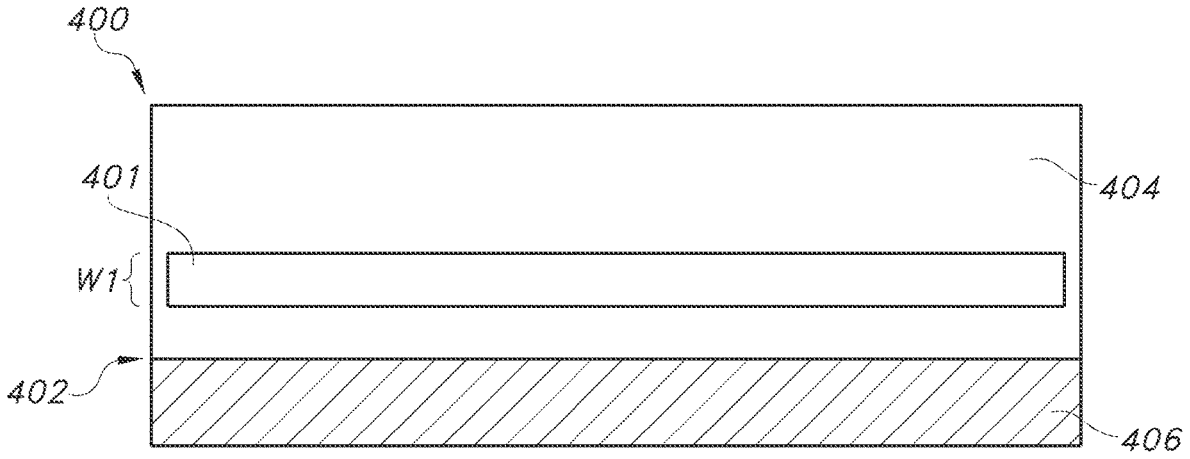
FIG. 10 illustrates a magnified view of the materials of the PPE of FIGS. 1-7 and 18-19, particularly showing a seam pattern of a continuous single bar according to the present disclosure.

FIG. 10 illustrates a magnified view of a seam pattern 400 that may be used for any of the seams discussed in reference to FIGS. 1-7 and 18-19. The seam pattern 400 is in the form of a continuous single bar 401 and is located about the length of a joining section 402 between a first material 404 and a second material 406, where the first material 404 and the second material 406 are composed of the same first material 200. Furthermore, the seam pattern 400 may not be limited to joining only the first material 404 and second material 406. For example, the seam pattern 400 may join at least the first material 404 and the second material 406 and any number of other materials.

In addition, the seam pattern 400's continuous bar 401 may be applied on a straight portion 180 (see FIGS. 1 and 2, referring to a straight seam that may join a section a of a sleeve 104 to the panel 102 of the gown 100) of the joining section 402, or alternatively, the continuous single bar 401 may be applied on a rounded or curved portion 182 (See FIGS. 1 and 2, referring to a seam joining a sleeve 104 and a cuff 106, which define a circular opening) of the joining section 402 such that the length can be defined as a circumference. Further, the length that the continuous single bar 401 is placed may span the entire length of the joining section 402 such that the continuous single bar 401 and the joining section 402 have the same length. However, the length of the continuous single bar 401 may not necessarily span the entire length of the joining section 402. For example, the length of the continuous single bar 401 of the seam pattern 400 may be about 85% to about 100% of the length of the joining section 402, such as about 87.5% to about 97.5%, such as about 90% to about 95%. By utilizing a continuous single bar 401 at this length of the joining section 402, a fluid barrier is formed which is capable of stopping the ingress or influx of potentially hazardous fluids. This feature is achieved, for example, as a result of the elastic or polymeric film 144 from a first material 404 and another elastic or polymeric film 144 from a second material being melted together (see FIG. 8). If the elastic or polymeric film 144 was not present, liquid may be able to pass through any nonwoven layers (e.g., nonwoven layer 142 and the SMS laminate 146 of the first material 200 shown in FIG. 8), which are both porous and breathable. Further, it should be understood that in some embodiments, the first material 404 and the second material 406 can each include just an elastic or polymeric film, such as film 144 in FIG. 10.

In addition to the continuous single bar 401 having a length, the continuous single bar 401 may have a width W1 ranging from about 0.02 millimeters (mm) to about 60 mm, such as about 0.04 mm to 45 mm, such as about 0.08 mm to about 30 mm, such as about 1.5 mm to about 15 mm. By having a width W1 falling within the ranges claimed, the continuous single bar 401 is capable of having sufficient strength for the needs of the medical field while also being capable of preventing the ingress of hazardous fluids.

Figure 11:
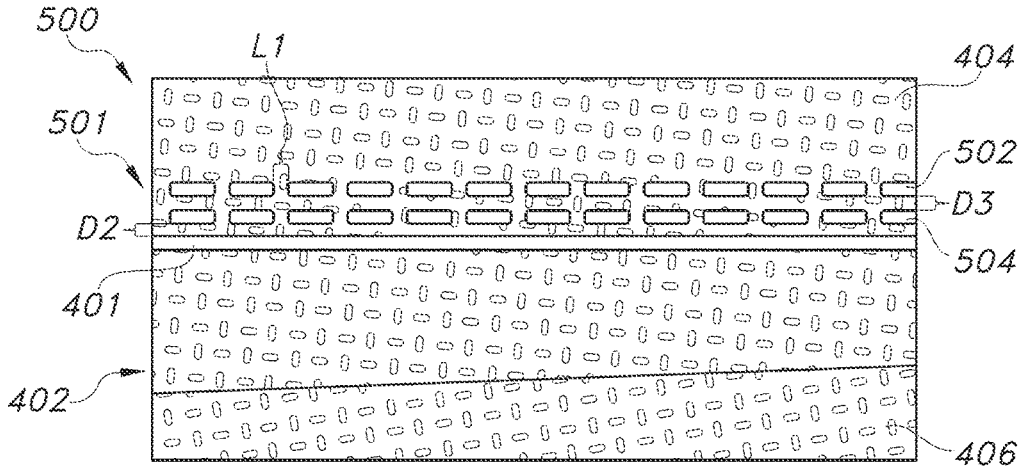
FIG. 11 illustrates a magnified view of the materials of the PPE of FIGS. 1-7 and 18-19, particularly showing a seam pattern of a continuous single bar and two series of discontinuous bars or lines placed adjacent to the single continuous bar according to the present disclosure.

FIG. 11 illustrates a magnified view of a seam pattern 500 of the continuous single bar 401 used in FIG. 10 and a pair discontinuous bars or lines placed adjacent to the continuous single bar 401 that may be used for any of the seams discussed in reference to FIGS. 1-7 and 17-18. The first discontinuous bar 502 may be a series of dotted or dashed lines and the second discontinuous bar 504 may be series of dotted or dashed lines collectively form an arrangement of discontinuous bars 501. It should be understood that any number of series of dotted or dashed lines may be used to form the arrangement. For example, one series of dotted or dashed lines may be used instead. Alternatively, three or more series of dotted or dashed lines may be used. Each of the dotted or dashed lines in a particular series may be placed any length from the other dotted or dashed lines in the series. However, by placing the dotted or dashed lines of a particular series at a predetermined length L1 from each other, the mechanical strength of the seam pattern may be improved further by having the force being applied to the seam spread out to the multiple dotted or dashed lines instead of concentrating on a particular point of the continuous single bar 401. For example, the predetermined length L1 between each of the dotted or dashed lines of a particular series may be from about 0.02 millimeters (mm) to about 60 mm, such as about 0.04 mm to 45 mm, such as about 0.08 mm to about 30 mm, such as about 1.5 mm to about 15 mm. By placing the dotted or dashed lines at the predetermined length L1, the force dispersion properties may be further enhanced. Further, like the continuous single bar 401, the first discontinuous bar 502 and the second discontinuous bar 504 may have a width W1 falling into the ranges described above.

In addition, the single continuous bar 401 defining the first continuous bar 702 may be placed a distance D2 from the second discontinuous bar 504 ranging from about [about 0.02 millimeters (mm) to about 60 mm, such as about 0.04 mm to 45 mm, such as about 0.08 mm to about 30 mm, such as about 1.5 mm to about 15 mm. Further, the first discontinuous bar 502 and the second series of dotted or dashed lines may be placed a distance D3 from each other. For example, the distance D3 may range from about 0.02 millimeters (mm) to about 60 mm, such as about 0.04 mm to 45 mm, such as about 0.08 mm to about 30 mm, such as about 1.5 mm to about 15 mm. Furthermore, the dotted or dashed lines of the first discontinuous bar 502 may be staggered in relation to the dotted or dashed lines of the second discontinuous bar 504. By staggering the dotted or dashed lines of the first discontinuous bar 502 in relation to the second discontinuous bar 504, mechanical forces may be further dispersed or spread out between the dotted or dashed lines of the first and second discontinuous bars 502, 504 respectively.

Figure 12:
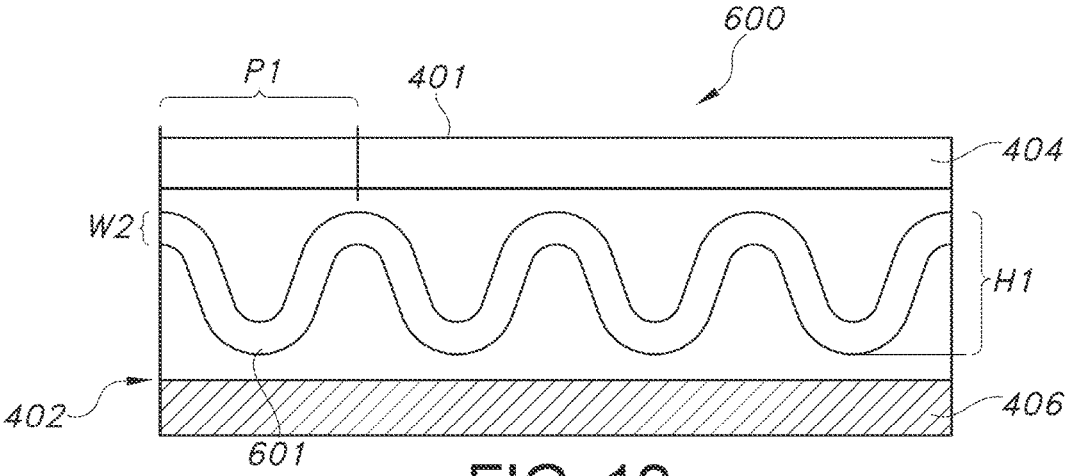
FIG. 12 illustrates a magnified view of the materials of the PPE of FIGS. 1-7 and 18-19, particularly showing a seam pattern of a continuous single bar and a continuous wave placed adjacent to the continuous single bar according to the present disclosure.

FIG. 12 illustrates a magnified view of a seam pattern 600 that includes the single continuous bar 401 used in FIG. 10 and a sinusoidal, wavy, or curved pattern placed adjacent to the continuous single bar 401 that may be used for any of the seams discussed in reference to FIGS. 1-7 and 17-18. The wavy or curved pattern 601 may be in the form of sinusoidal pattern having a peak-to-peak length P1 ranging from about 3 mm to about 6 mm, such as about 3.5 mm to about 5.5 mm, such as about 4 mm to about 5 mm. Further, the wavy or curved pattern 601 may have a height H1 measuring from a peak of one wave to the trough of the same wave. The height H1 may range from about 2.5 mm to about 4.5 mm, such as about 3 mm to about 5 mm, such as about 3.5 mm to about 4.5 mm. Furthermore, the wavy or curved pattern 601 may have a width W2. The width W2 refers to the widest point of the bonded or welded areas along any portion of the overall length of the pattern and may range from about 0.5 mm to about 1 mm, such as about 0.6 mm to about 0.9 mm, such as about 0.7 mm to about 0.85 mm.

Figure 13:
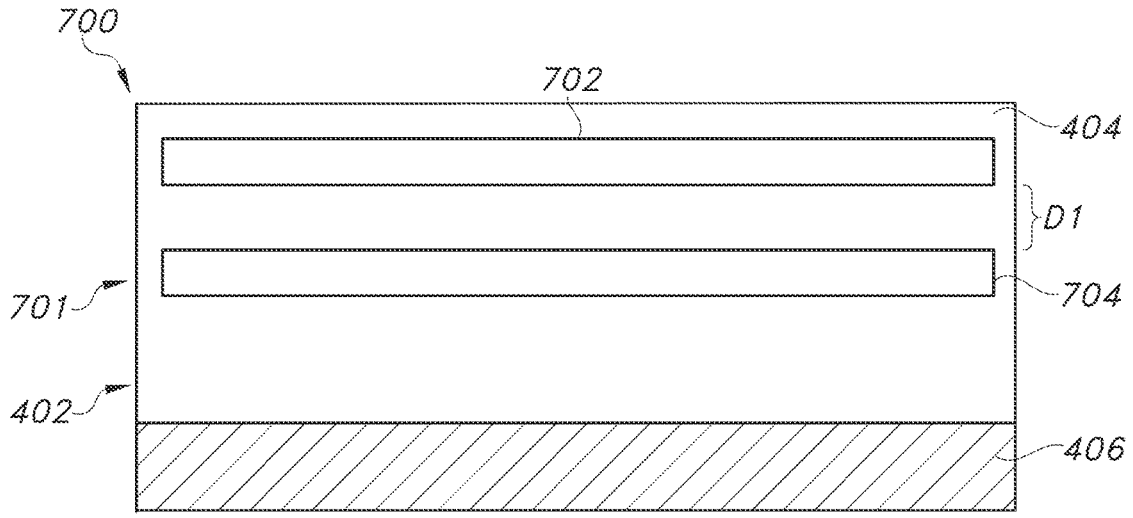
FIG. 13 illustrates a magnified view of the materials of the PPE of FIGS. 1-7 and 18-19, particularly showing a continuous double bar according to the present disclosure.

FIG. 13 illustrates a magnified view of a seam pattern 700 having a continuous double bar 701 that may be used for any of the seams discussed in reference to FIGS. 1-7 and 17-18. In particular, the seam pattern includes a continuous double bar 701 that is composed of the first continuous bar 702 of FIG. 10 and a second continuous bar 704 collectively. The first continuous bar 702 may be parallel to the second continuous bar 704 or alternatively, the first continuous bar 702 and the second continuous bar 704 may intersect with each other. Like the continuous single bar 401 of FIGS. 10-12, the continuous double bar 701 is placed about the length of a joining section 402 between a first material 404 and a second material 406, where the first material 404 and the second material 406 are composed of the same material which may be the first material 200. Moreover, like the continuous single bar 401, the continuous double bar 701 may be applied to a straight portion 180 (see FIGS. 1 and 2, referring to a straight seam that may join a section a of a sleeve 104 to the panel 102 of the gown 100) of a joining section 402, or alternatively, may be applied to a rounded or curved portion 182 (see FIGS. 1 and 2, referring to a seam joining a sleeve 104 and a cuff 106, which define a circular opening) of a joining section such that the length can be defined as a circumference. Further, the continuous double bar 701 may also span the entire length of the joining section or instead may instead only cover about 85% to about 100% of the length of the joining section 402, such as about 87.5% to about 97.5%, such as about 90% to about 95%.

By placing a second continuous bar 704 and forming a continuous double bar 701, manufacturing defects may be mitigated which may result in an ingress of hazardous fluids in the event the first continuous bar 702. For example, the second continuous bar 704 may provide further mechanical strength than the first continuous bar 702 alone such that mechanical forces that would cause a first continuous bar 702 alone to fail would be insufficient to cause both the first continuous bar 702 and second continuous bar 704 to fail when used together.

Further, like the continuous single bar 401, both the first continuous bar 702 and the second continuous bar 704 may each have a width W1, however the first continuous bar 702 and second continuous bar 704 may also have different widths from each other within the predetermined width W1. Furthermore, the first continuous bar 702 and the second continuous bar 704 may be placed at a distance D1 from each other. The distance D1 may range from about 0.02 millimeters (mm) to about 60 mm, such as about 0.04 mm to 45 mm, such as about 0.08 mm to about 30 mm, such as about 1.5 mm to about 15 mm.

Figure 14:
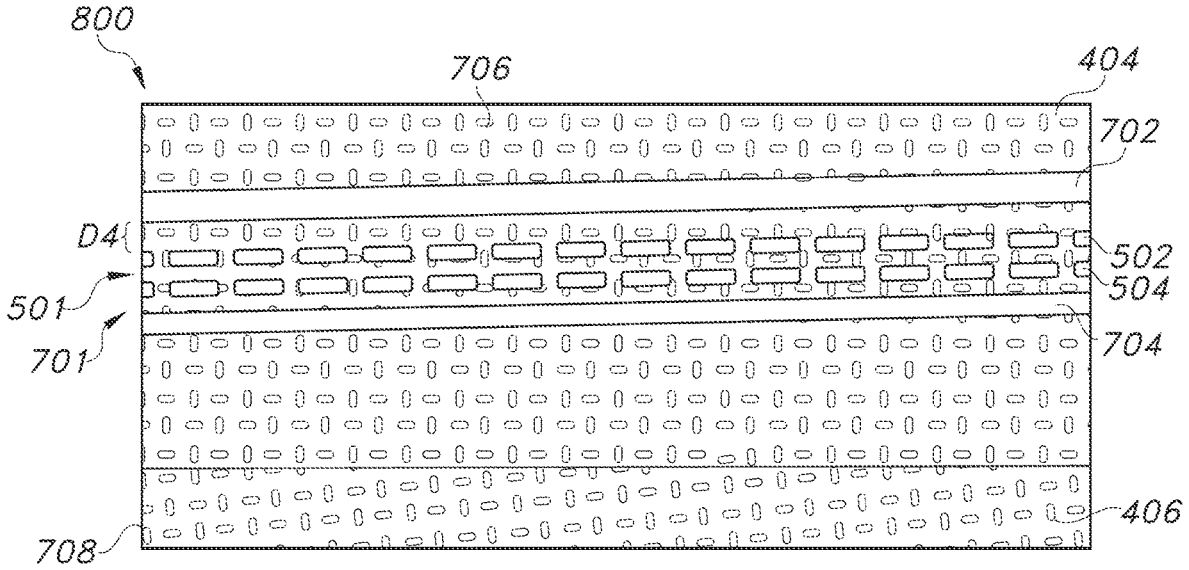
FIG. 14 illustrates a magnified view of the materials of the PPE of FIGS. 1-7 and 18-19, particularly showing a seam pattern of a continuous double bar and two series of discontinuous bars or lines placed in between the continuous double bar according to the present disclosure.

FIG. 14 illustrates a magnified view of a seam pattern 800 of the continuous double bar 701 of FIG. 13 and a pair of dotted or dashed lines placed in between the continuous double bar 701 that may be used for any of the seams discussed in reference to FIGS. 1-7 and 17-18. In particular, a first continuous bar 702 and a second continuous bar 704 may collectively form a continuous double bar 701. Further, at least a first discontinuous bar 502 and a second discontinuous bar 504 collectively form an arrangement of discontinuous bars 501 applied in a gap 703 in between the continuous double bar 701. Similar to FIG. 11, the arrangement 801 may include any number of rows of discontinuous bars 502, 504, etc. For example, one series of dotted or dashed lines may be used instead. Alternatively, three or more series of dotted or dashed lines may be used. Also, like FIG. 11, each line in a particular series of dotted or dashed lines may be placed any length L1 from each other, but by placing the dotted or dashed lines of a particular series at a predetermined length L1 from each other, mechanical strength of the seam pattern may be improved further by having the force being applied to the seam spread out to the multiple discontinuous bars instead of concentrating on a particular point of the continuous double bar 701. For example, the predetermined length L1 between each of the dotted or dashed lines of a particular series may be from 0.02 millimeters (mm) to about 60 mm, such as about 0.04 mm to 45 mm, such as about 0.08 mm to about 30 mm, such as about 1.5 mm to about 15 mm. Furthermore, the first continuous bar 702 and the second continuous bar 704 may be placed at a distance D1 from each other. The distance D1 may range from about 4 mm to about 9 mm, such as about 5 mm to about 8 mm, such as about 6 mm to about 7 mm.

In addition, as discussed in reference to FIG. 11, the first continuous bar 702 may be placed a distance D2 from the second discontinuous bar 504 ranging from about 0.02 millimeters (mm) to about 60 mm, such as about 0.04 mm to 45 mm, such as about 0.08 mm to about 30 mm, such as about 1.5 mm to about 15 mm. Further, the first discontinuous bar 502 and the second series of dotted or dashed lines may be placed a distance D3 from each other. For example, the distance D3 may range from 0.02 millimeters (mm) to about 60 mm, such as about 0.04 mm to 45 mm, such as about 0.08 mm to about 30 mm, such as about 1.5 mm to about 15 mm. Furthermore, second continuous bar 704 may be placed a distance D4 from the second series of dotted or dashed lines 802 ranging from about 0.02 millimeters (mm) to about 60 mm, such as about 0.04 mm to 45 mm, such as about 0.08 mm to about 30 mm, such as about 1.5 mm to about 15 mm.

In addition, when referring to the continuous double bar 701 and arrangement of discontinuous bars 501 of FIG. 14 or other continuous double bars 701 with discontinuous patterns placed in between them, the second continuous bar 704 may allow for greater manufacturing flexibility when placing a seam designed to prevent the ingress of hazardous fluids. For example, a seam designed to prevent the ingress of hazardous fluids is typically placed as far down the exterior material 706 as allowable so that there is less room for hazardous fluids to penetrate either the exterior material 706 or the interior material 708. With a first continuous bar 702 alone, the manufacturer may accidentally apply the arrangement of discontinuous bars 501 on the side that is furthest down the exterior material 706 which may allow for greater penetration of hazardous fluids through the arrangement of discontinuous bars 501. However, this issue is less likely to occur when the seam pattern includes a second continuous bar 704. Regardless of whether the manufacturer applies the seam pattern facing upwards or facing downwards, either the first continuous bar 702 or the second continuous bar 704 will be placed as far down the exterior material 706 to prevent the ingress of hazardous fluids.

Figure 15:
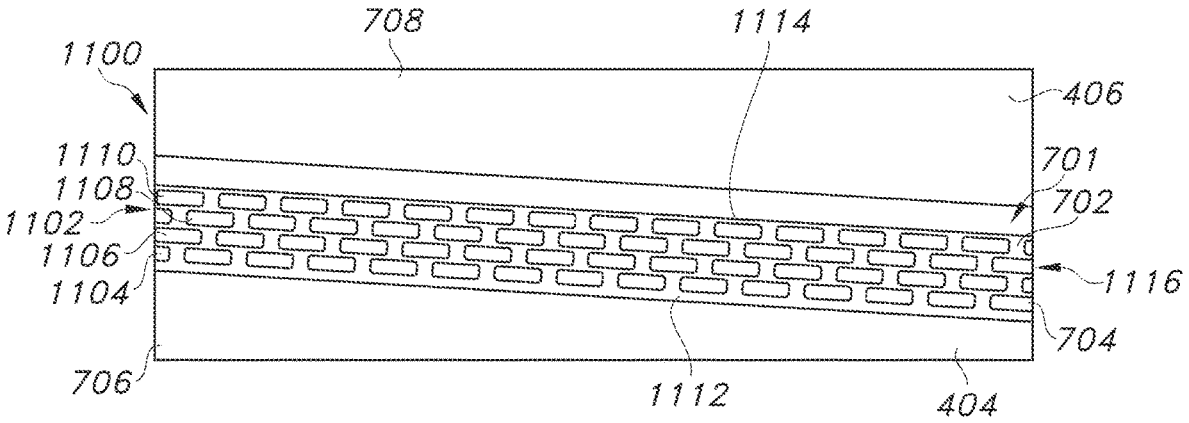
FIG. 15 illustrates a magnified view of the materials of the PPE of FIGS. 1-7 and 18-19, particularly showing a seam pattern of a double continuous bar with a grid pattern placed in between a first continuous bar and a second continuous bar.

FIG. 15 illustrates a magnified view of a seam pattern 1100 that includes a double continuous bar 701 with a grill pattern 1102 placed in between a first continuous bar 702 and a second continuous bar 704. The grill pattern 1102 may also include a first series of discontinuous gaps 1104, a second series of discontinuous gaps 1106, a third series of discontinuous gaps 1108, and a fourth series of discontinuous gaps together forming an arrangement of series of discontinuous gaps 1116 that connect the first continuous bar 702 to the second continuous bar 704. Similar to FIG. 14, the seam pattern 1100 may also allow for greater manufacturing flexibility when placing a seam designed to prevent the ingress of hazardous fluids as a result of the seam pattern's 1100 placement in relation to the exterior 706 and interior material 708. For example, the top of the seam 1112 may be placed closer to the end of the exterior material 706 (or vice versa) in relation to the bottom of the seam 1114 without affecting the overall seam pattern 1100's placement on the exterior material 706 and affecting the fluid imperviousness of the materials 404, 406.

Figure 16:
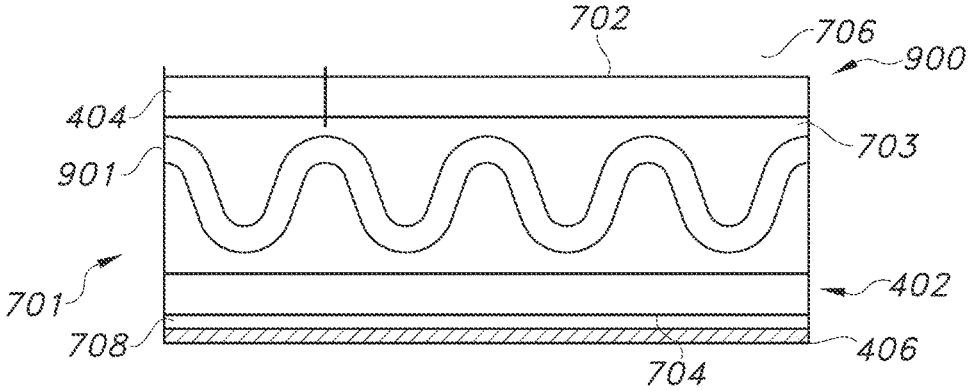
FIG. 16 illustrates a magnified view of the materials of the PPE of FIGS. 1-7 and 18-19, particularly showing a seam pattern of a continuous double bar and a continuous wave placed in between the continuous double bar according to the present disclosure.
Figure 17:
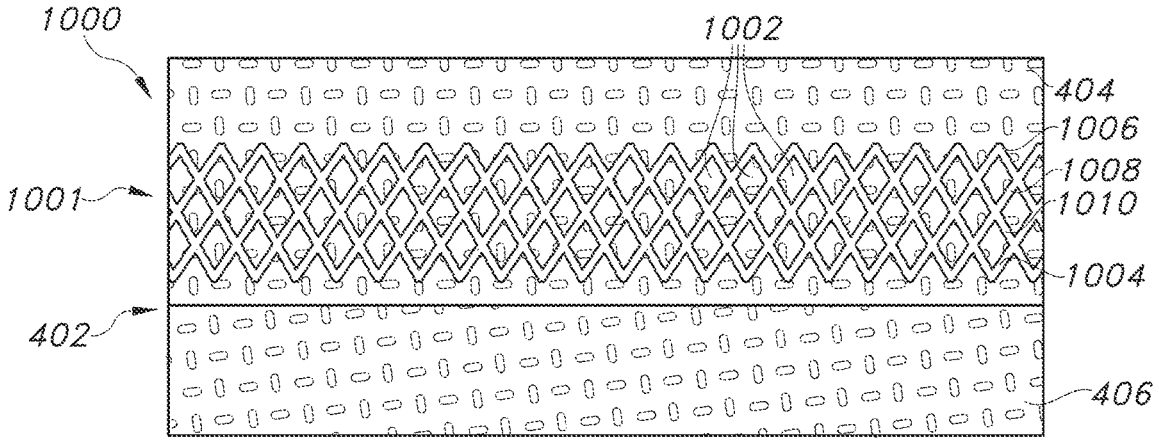
FIG. 17 illustrates a magnified view of the materials of the PPE of FIGS. 1-7 and 18-19, particularly showing a seam pattern of a series of continuous zig zag bars or lines applied adjacent each other according to the present disclosure.

FIGS. 16-17 show magnified views of various other forms of seam patterns which used to form a fluid impervious seam between two materials. For example, FIG. 16 shows a seam pattern 900 of a continuous double bar 701 with a sinusoidal, wavy, or curved pattern 901 applied in a gap 703 between the continuous double bar 701 similar to the sinusoidal, wavy or curved pattern 601 of FIG. 12. For example, FIG. 17 shows a seam pattern 1000 that includes a series of continuous zig zag bars or lines 1001 positioned adjacent each other. The series of zig zag bars or lines may include a first continuous zig zag bar or line 1004 and a second continuous zig zag bar or line 1006. The series of zig zag bars or lines may further include a third zig zag bar or line 1008 and a fourth zig zag bar or line 1010. Further, the first and second zig zag bars or lines 1004, 1006 may be external in relation to the third and fourth zig zag bars or lines 1008, 1010 while the third and fourth zig zag bars or lines 1008, 1010 may be external when compared to the first and second zig zag bars or lines 1004, 1006. Like FIGS. 10-16, the zig zag bars or lines being continuous allows them to form a seal when applied to materials. The zig zag bars or lines 1004, 1006, 1008, 1010 may intersect with each other and connect such that interior gaps 1002 are formed. It should be understood that the interior gaps 1002 allow for greater flexibility of the seam pattern 1000 and greater force dispersion as compared to a seam pattern without interior gaps 1002. In addition, because the interior gaps 1002 are contained within the zig zag bars or lines 1004, 1006, 1008, 1010, fluid or other contaminants are not trapped within the seam pattern unlike what may happen with a seam pattern with exterior gaps not contained by zig zag bars or lines 1004, 1006, 1008, 1010. Like the previous seam patterns of FIGS. 10-16, the seam pattern 1000 may be applied via ultrasonic or thermal bonding to any of the two materials including an elastic or polymeric film such that a fluid impermeable seam may be formed.

Figure 18:
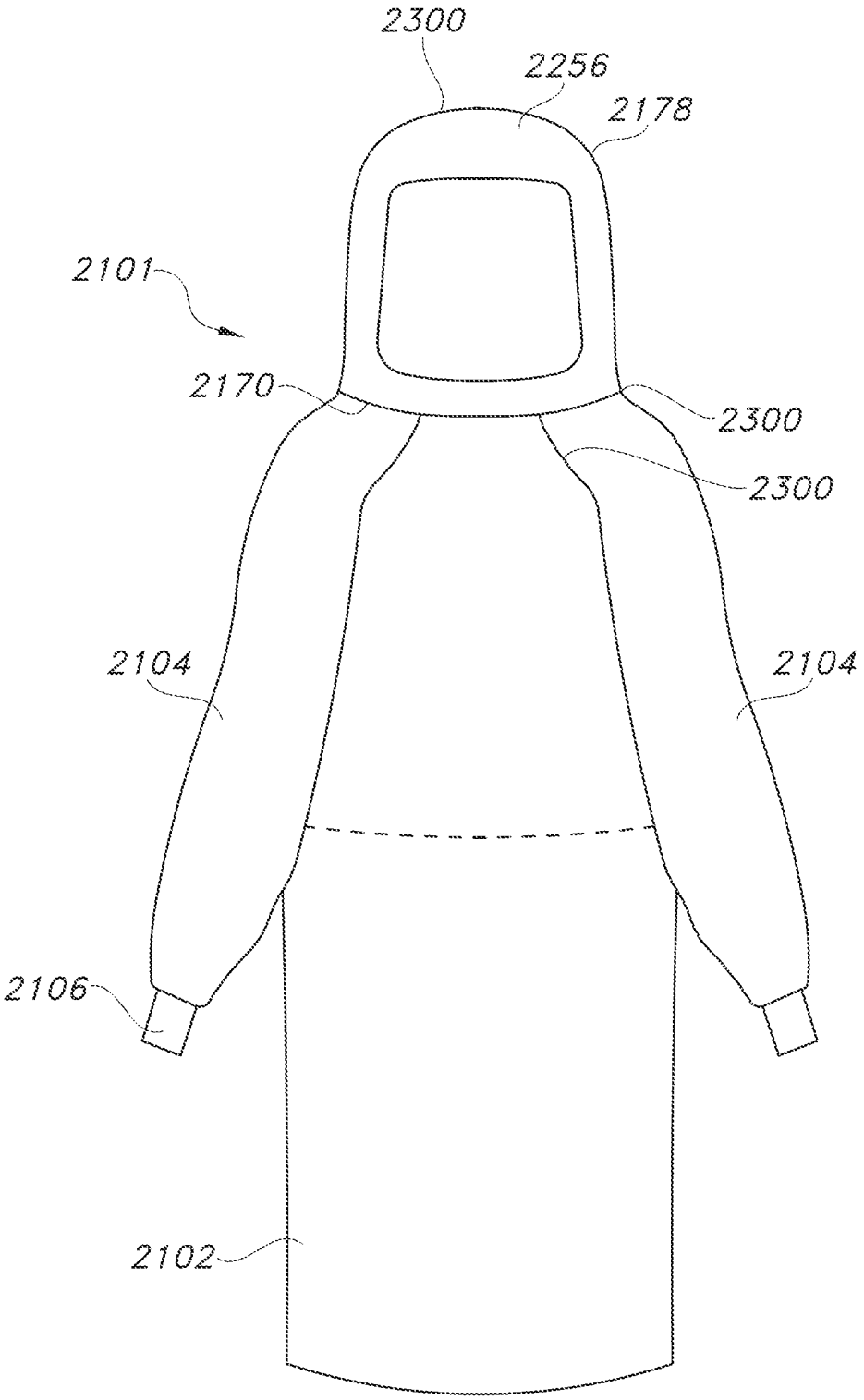
FIG. 18 illustrates a front view of another example of PPE (e.g., a medical hood and toga) according to the present disclosure.
Figure 19:
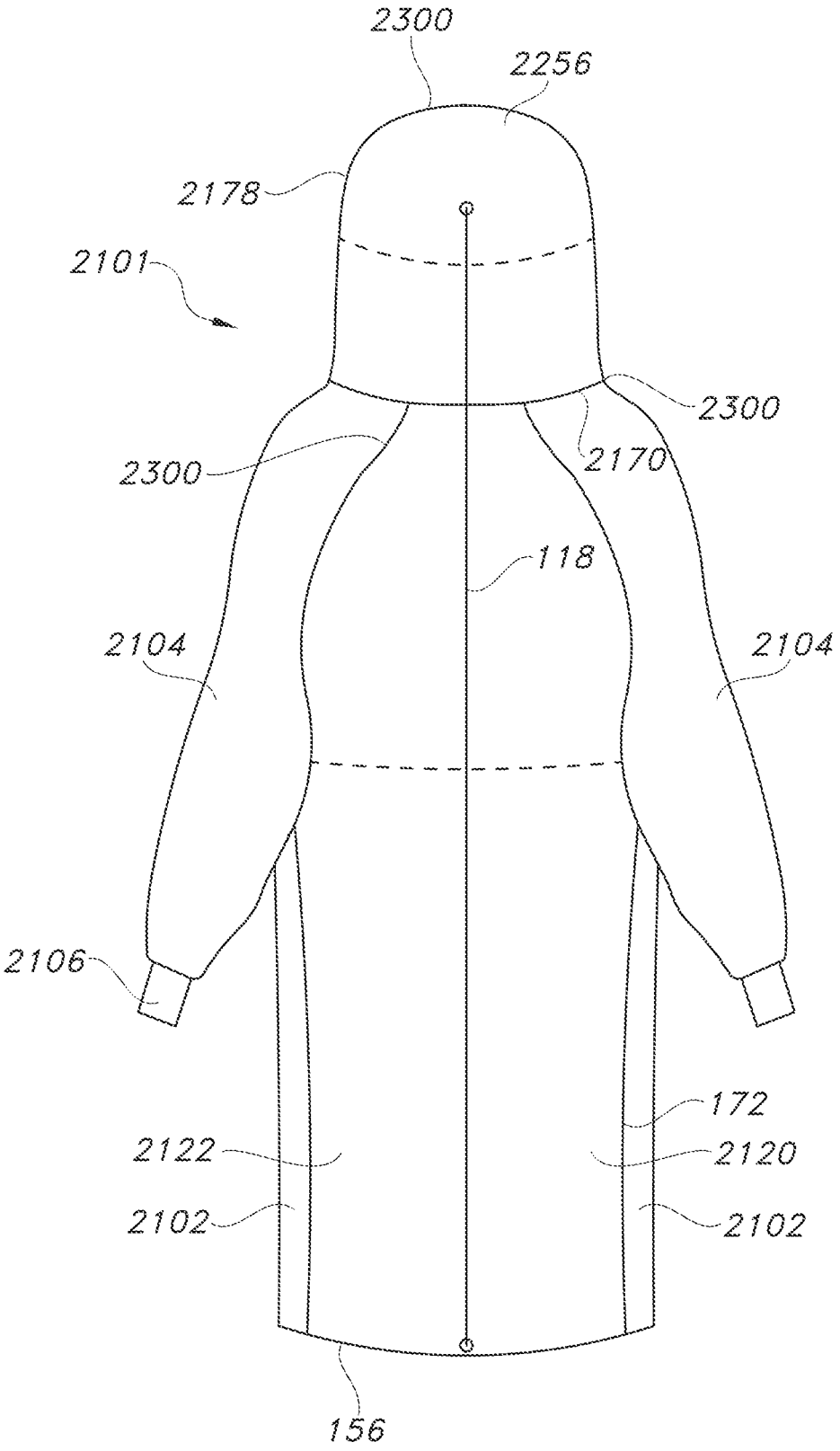
FIG. 19 illustrates a rear view of the medical hood and toga of FIG. 18 according to the present disclosure.

FIGS. 18-19 illustrate a front and rear view of a medical toga and hood particularly showing a radius of curvature 2300 of an example seam. One benefit of the seams discussed in FIGS. 10-17 is that the seam patterns may be either straight or curved. The benefits of straight seams are similar to the benefits discussed above. However, curved seams allow for greater applications in forming seams between two materials. For example, the seam may be used to form a collar 2170 of the medical toga 2101, a sleeve 2104 of a medical toga 2101, the crest 2256 of a medical hood 2178, or any other part of a medical gown which is curved. The radius of curvature 2300 of these seams may range from about 6 mm to about 260 meters, such as about 20 mm to about 200 meters, such as about 50 mm to about 100 meters, such as about 1 centimeter (cm) to about 50 meters, such as about 5 cm to about 25 meters, such as about 25 cm to about 10 meters, such as about 50 cm to about 5 meters, such as about 1 meter to about 5 meters. These variety of values of radius of curvature 2300 allow for the seam to be formed in the aforementioned parts of the medical toga 2101 and hood 2178.

Furthermore, when these seams are formed a complete seal of a wearer of the toga and hood may be formed such that the wearer is protected from the ingress of fluids. For example, a complete seal may be formed when the hood 2178 is bonded with the medical toga 2101; the sleeves 2104 are bonded with the collar 2170, the front panel 2102, the first rear panel 2120, the second rear panel 2122, and cuffs 2106; and the front panel 2102 is bonded with the first and second rear panels 2120, 2122.

In addition to the application with medical togas and hoods, the radius of curvature 2300 allowable by the seam patterns discussed above may also be used in other types of garments. For example, the seam pattern may be used to form seams placed upon medical drapes, medical caps, medical gowns masks, foot coverings, or any other form of personal protective equipment ("PPE") product which has curved seams.

The present invention has been described both in general and in detail by way of examples. These and other modifications and variations of the present invention may be practiced by those of ordinary skill in the art, without departing from the spirit and scope of the present invention. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A seam pattern comprising:

a continuous double bar comprising a first continuous bar and a second continuous bar; and a first discontinuous bar located between the first continuous bar and the second continuous bar, wherein the first discontinuous bar includes a series of dotted or dashed lines including a predetermined length in a range from about 0.02 mm to about 60 mm between each of the dotted or dashed lines of the series, and a second discontinuous bar located between the first continuous bar and the second continuous bar and adjacent to the first continuous bar, wherein the seam pattern creates a seal when joining a first material with a second material.

2. The seam pattern of claim 1, wherein the continuous double bar and the first discontinuous bar are formed via at least one of ultrasonic bonding or welding or thermal bonding.

3. The seam pattern of claim 1, wherein the seam pattern is applied on a drape, a gown, a cap, a hood, a mask, a foot covering, or a toga.

4. The seam pattern of claim 3, wherein the seam pattern is applied on a rounded portion of the drape, the gown, the cap, the hood, the mask, the foot covering, or the toga.

5. The seam pattern of claim 4, wherein the seam pattern has a radius of curvature ranging from about 6 mm to about 260 meters.

6. The seam pattern of claim 2, wherein the first material and the second material comprise an elastic or a polymeric film, wherein the elastic or polymeric film of the first and second material forms a fluid impervious seal when bonded together.

7. The seam pattern of claim 1, wherein the second discontinuous bar includes a series of dotted or dashed lines.

8. The seam pattern of claim 7, wherein the series of dotted or dashed lines of the first discontinuous bar and the series of dotted or dashed lines of the second discontinuous bar are parallel to each other.

9. A personal protective equipment product comprising a first material joined to a second material by a seam pattern, wherein at least one of the first material or the second material comprises:

an outer nonwoven layer, an inner nonwoven layer, and an elastic or polymeric film placed between the outer nonwoven layer and the inner nonwoven layer;

wherein the seam pattern comprises:

a continuous double bar comprising a first continuous bar and a second continuous bar; and a first discontinuous bar located between the first continuous bar and the second continuous bar, wherein the first discontinuous bar includes a series of dotted or dashed lines including a predetermined length in a range from about 0.02 mm to about 60 mm between each of the dotted or dashed lines of the series, and a second discontinuous bar located between the first continuous bar and the second continuous bar and adjacent to the first continuous bar.

10. The personal protective equipment product of claim 9, wherein the continuous double bar and the first discontinuous bar are formed via at least one of ultrasonic bonding or welding or thermal bonding.

11. The personal protective equipment product of claim 9, wherein the seam pattern is applied on a drape, gown, a cap, a hood, a mask, a foot covering, or toga.

12. The personal protective equipment product of claim 11, wherein the seam pattern is applied on a rounded portion of the drape, the gown, the cap, the hood, the mask, the foot covering, or the toga.

13. The personal protective equipment product of claim 12, wherein the seam pattern has a radius of curvature ranging from about 6 mm to about 260 meters.

14. The personal protective equipment product of claim 9, wherein the first material and the second material both comprise an outer nonwoven layer, an inner nonwoven layer, and an elastic or polymeric film placed between the outer nonwoven layer and the inner nonwoven layer.

15. The personal protective equipment product of claim 13, a fluid impervious seal is formed when the elastic or polymeric film of the first material is bonded with the elastic film or polymeric of the second material.

16. The personal protective equipment product of claim 9, wherein the second discontinuous bar includes a series of dotted or dashed lines.

17. The personal protective equipment product of claim 9, wherein the inner nonwoven layer and the outer nonwoven layer comprise a spundbond material, a meltblown material, or a spunbond-meltblown-spunbond (SMS) laminate.

18. The personal protective equipment product of claim 10, wherein the second discontinuous bar is formed via at least one of ultrasonic bonding or welding or thermal bonding.

* * * * *